US009466923B2

(12) United States Patent
Hu et al.

(10) Patent No.: US 9,466,923 B2
(45) Date of Patent: Oct. 11, 2016

(54) FEMALE CONNECTOR FOR HIGH-SPEED TRANSMISSION

(71) Applicant: BizConn International Corp., Guangdong Province (CN)

(72) Inventors: Hai-Xi Hu, Guangdong Province (CN); Jia-Mao Zheng, Guangdong Province (CN); Hong-Guang Kuang, Guangdong Province (CN)

(73) Assignee: BizConn International Corp., Guangdong Province (CN)

( * ) Notice: Subject to any disclaimer, the term of this patent is extended or adjusted under 35 U.S.C. 154(b) by 0 days.

(21) Appl. No.: 14/736,237

(22) Filed: Jun. 10, 2015

(65) Prior Publication Data

US 2016/0036169 A1 Feb. 4, 2016

(30) Foreign Application Priority Data

Jul. 31, 2014 (CN) ..... 2014 2 0427091 U

(51) Int. Cl.

| | |
|---|---|
| ***H01R 13/648*** | (2006.01) |
| ***H01R 13/6585*** | (2011.01) |
| ***H01R 24/60*** | (2011.01) |
| *H01R 107/00* | (2006.01) |

(52) U.S. Cl.

CPC ..... *H01R 13/6585* (2013.01); *H01R 24/60* (2013.01); *H01R 2107/00* (2013.01)

(58) Field of Classification Search

CPC ..... H01R 13/658; H01R 13/6585; H01R 13/6586; H01R 23/688; H01R 13/6581; H01R 13/6597

USPC ..... 439/607.05, 607.55, 660

See application file for complete search history.

(56) References Cited

U.S. PATENT DOCUMENTS

| | | | | |
|---|---|---|---|---|
| 9,306,336 | B2 * | 4/2016 | Chang | H01R 13/6471 |
| 9,350,121 | B2 * | 5/2016 | Ju | H01R 13/6585 |
| 2016/0020560 | A1 * | 1/2016 | Ju | H01R 24/78 439/607.05 |
| 2016/0020568 | A1 * | 1/2016 | Ju | H01R 24/78 439/607.01 |
| 2016/0020572 | A1 * | 1/2016 | Ju | H01R 24/78 264/272.14 |

* cited by examiner

*Primary Examiner* — Hae Moon Hyeon

(74) *Attorney, Agent, or Firm* — CKC & Partners Co., Ltd.

(57) ABSTRACT

Provided is a female connector for high-speed transmission, including a case, an insulating body, an upper terminal group and a lower terminal group. The insulating body includes an upper insulating body, a middle insulating body, and a lower insulating body. The upper terminal group is disposed on the upper insulating body. The lower terminal group is disposed on the lower insulating body. The upper insulating body and the lower insulating body are engaged with the middle insulating body to form an integrated connector body. The connector body is disposed in the case. The insulating body can receive various terminals and can be fabricated and installed easily.

10 Claims, 4 Drawing Sheets

FEMALE CONNECTOR FOR HIGH-SPEED TRANSMISSION

RELATED APPLICATIONS

This application claims priority to Chinese Patent Application Serial Number 201420427091.2, filed on Jul. 31, 2014. The entirety of the above-mentioned application is hereby incorporated by reference and made a part of this specification.

BACKGROUND

1. Field of Invention

The present invention is related to a connector, and more particularly, to a female connector for high-speed transmission.

2. Description of Related Art

With the rapid development of electronic products, connectors for transmitting electrical signals have been applied widely. One example for such connectors is a female connector for high-speed transmission, which is capable of receiving data signals. Conventionally, the fabrication of the female connector for high-speed transmission includes fabricating an insulating body and two terminal groups, in which the insulating body is integrally formed. The connector body is then formed by disposing sockets on the insulating body and plugging the two terminal groups into the insulating body.

As applications of the female connector for high-speed transmission is becoming more and more broad and diversified, the type of the terminal in the connector also becomes increasingly diversified. The structure of the female connector for high-speed transmission is sophisticated. In order to receive various types of terminals, the conventional skill has to fabricate different types of insulating bodies and then plug various terminal groups into the corresponding insulating bodies correspondingly, thus greatly increasing the fabrication difficulty level.

SUMMARY

To solve the aforementioned issues, the present invention provides a female connector for high-speed transmission having an insulating body that is capable of receiving various terminals and is easy to fabricate and install.

A technical solution of the present invention is to design a female connector for high-speed transmission, including a case, an insulating body, an upper terminal group and a lower terminal group. The insulating body includes an upper insulating body, a middle insulating body, and a lower insulating body. The upper terminal group is disposed on the upper insulating body. The lower terminal group is disposed on the lower insulating body. The upper insulating body and the lower insulating body are engaged with the middle insulating body to form an integrated connector body. The connector body is disposed in the case.

As a further improvement to the aforementioned technical solution, one or both of the upper terminal group and the lower terminal group includes a high frequency terminal pair. The thickness of a contact portion of the high frequency terminal pair is smaller than the thickness of a portion of the high frequency terminal pair adjacent to the contact portion.

As a further improvement to the aforementioned technical solution, the thickness of the contact portion of the high frequency terminal pair is larger than or equal to 60% of the thickness of the portion of the high frequency terminal pair adjacent to the contact portion, and is smaller than or equal to 90% of the thickness of the portion of the high frequency terminal pair adjacent to the contact portion.

As a further improvement to the aforementioned technical solution, the width of a portion of the high frequency terminal pair inside of the insulating body is smaller than the width of a low frequency terminal or a grounding terminal adjacent to the portion of the high frequency terminal pair.

As a further improvement to the aforementioned technical solution, a first shielding engaging case and a second shielding engaging case are further included. A first hook is disposed on the first shielding engaging case. A second hook is disposed on the second shielding engaging case. A first hooking portion and a second hooking portion are disposed on the upper surface and the lower surface of the middle insulating body, respectively. The first shielding engaging case is engaged with the upper surface of the middle insulating body, wherein the first hook is interlocked with the corresponding second hooking portion on the middle insulating body. The second shielding engaging case is engaged with the lower surface of the middle insulating body, wherein the second hook is interlocked with the corresponding first hooking portion on the middle insulating body.

As a further improvement to the aforementioned technical solution, the middle insulating body further includes a metal sheet, wherein the metal sheet includes a plurality of through holes for improving high frequency performance.

As a further improvement to the aforementioned technical solution, the metal sheet further includes an upper spring plate and a lower spring plate.

As a further improvement to the aforementioned technical solution, a rib is disposed around the case.

In the present invention, the insulating body is divided into three parts, i.e. the upper insulating body, the middle insulating body, and the lower insulating body. Then the upper terminal group is disposed directly on the upper insulating body. The lower terminal group is disposed directly on the lower insulating body. As a result, different terminal groups are disposed directly on the insulating body. Then the upper insulating body and the lower insulating body are engaged with the middle insulating body to form an integrated connector body. Therefore, the insulating body can receive various terminals and can be fabricated and installed easily.

BRIEF DESCRIPTION OF THE DRAWINGS

The invention can be more fully understood by reading the following detailed description of the embodiment, with reference made to the accompanying drawings as follows.

DETAILED DESCRIPTION

In the description of the present invention, it should be noticed, direction or position relation indicated by terms such as "at the center of," "on," "below," "in front of,"

"behind," "at the left of," "at the right of" are orientation or position relation in connection with the figures. These terms are used to simplify the description of the present invention, and are not intended to indicate or suggest a specific configuration or orientation for operation for the device or element being described. Therefore, these terms cannot be construed as limitations to the present invention. In addition, terms such as "first" and "second" are used for descriptive purpose and shall not be construed as indicating or suggesting an element is more significant than another.

In the description of the present invention, it should be noticed, unless otherwise specified, terms such as "mounted," "joined," and "connected" should be construed in their broad sense. For example, "connected" includes "fixedly connected," "detachably connected," or "integrally connected"; it also includes "mechanically connected" or "electrically connected"; it further includes "directly connected," "connected via an intermediate element," or implies the inner connection of two elements. The meaning of these terms in the present invention can be understood by the persons having ordinary skills in the art in light of the specific context. In addition, unless otherwise specified, in the description of the present invention, "a plurality of," or "several" means two or more than two.

Figure 1:
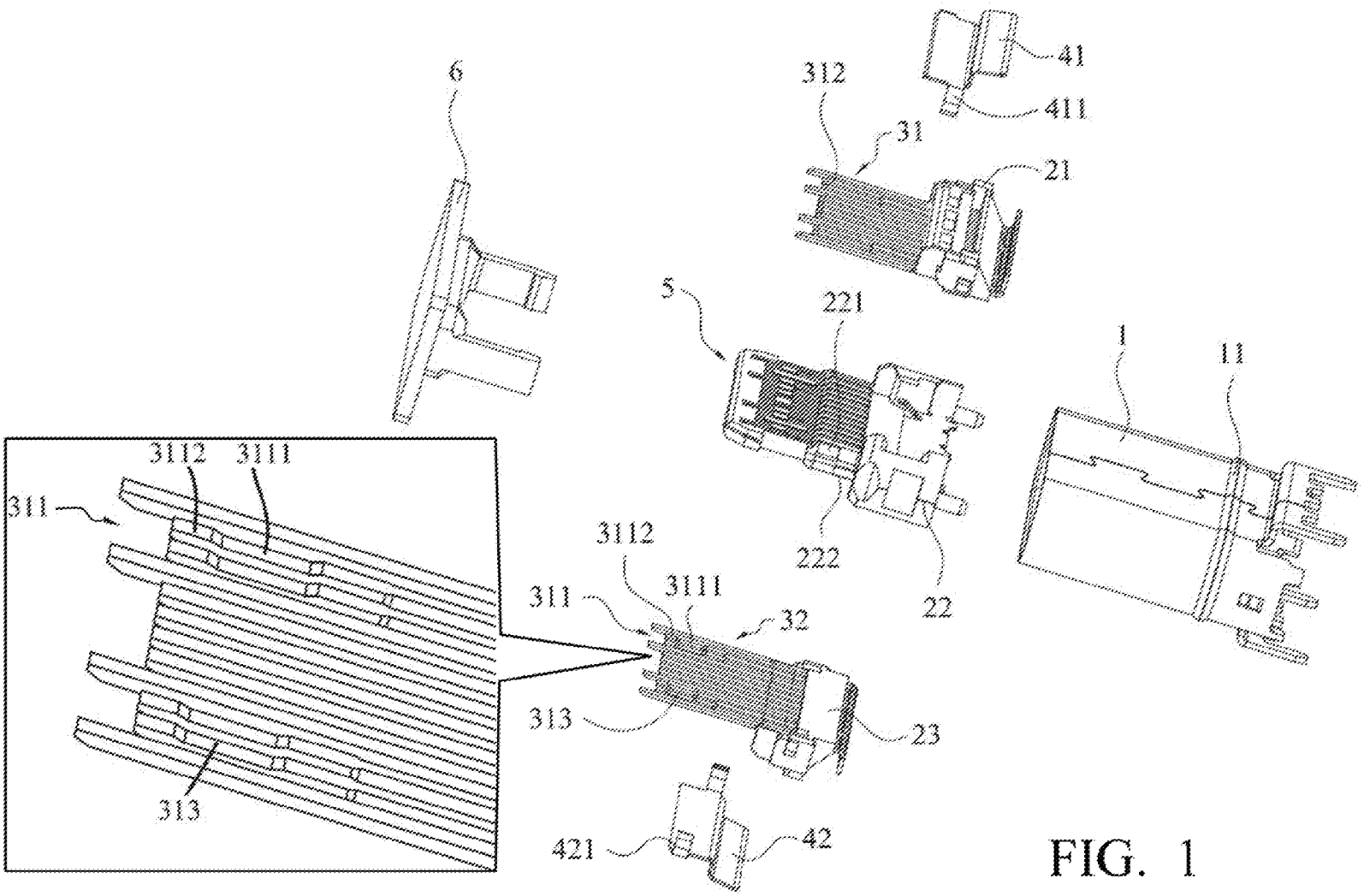
FIG. 1 is a schematic exploded view of an embodiment of the present invention.
Figure 2:
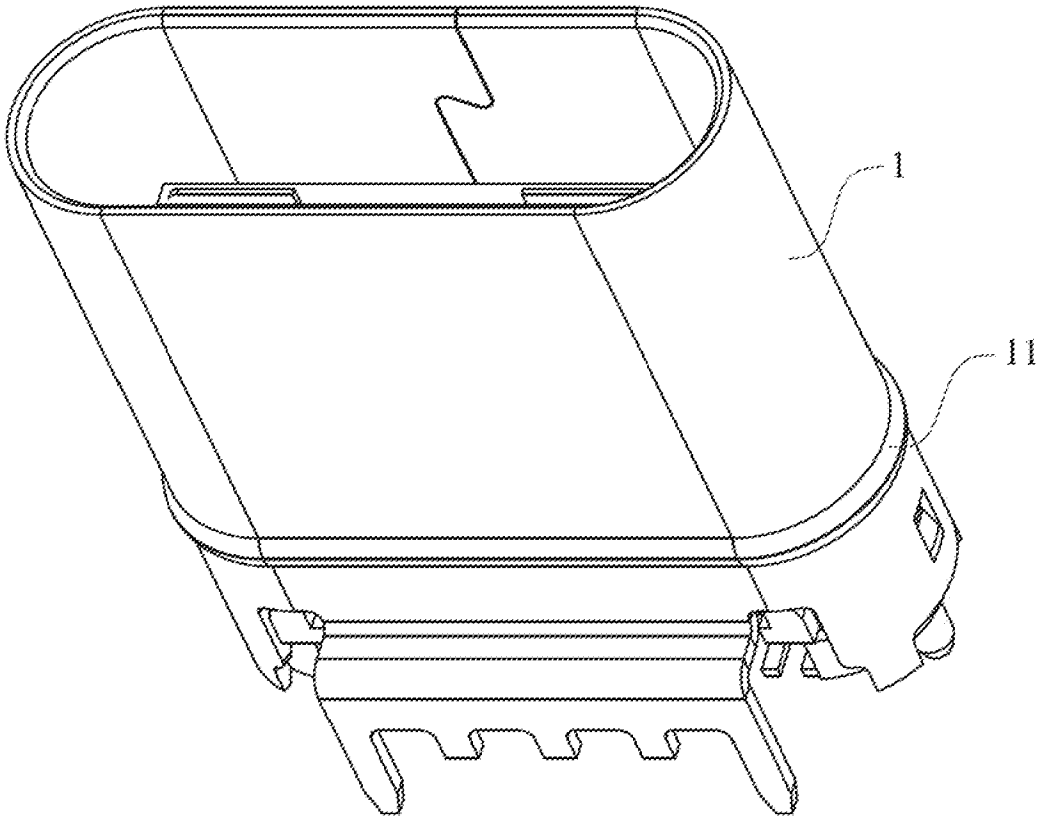
FIG. 2 is a schematic three-dimensional structural diagram of a structure formed by assembling a part of the components of FIG. 1.
Figure 3:
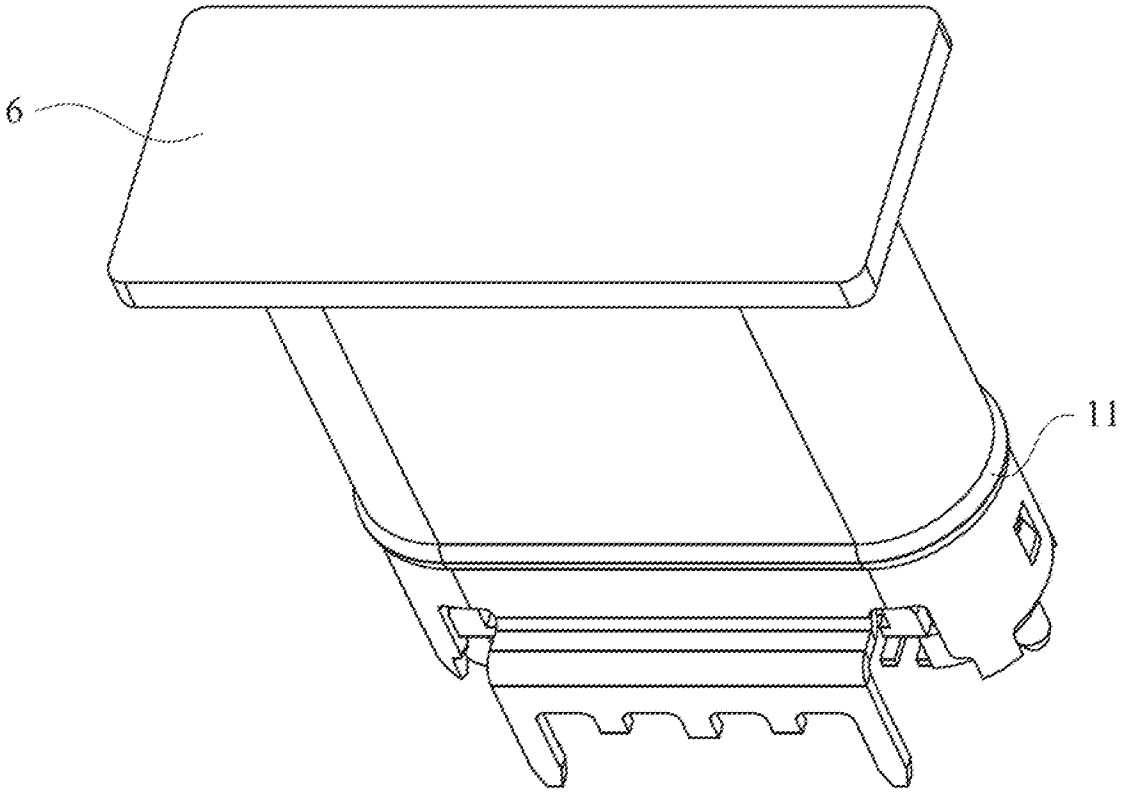
FIG. 3 is a schematic three-dimensional structural diagram of a structure formed by assembling all components of FIG. 1.

Please refer to FIG. 1 to FIG. 4. FIG. 1 to FIG. 4 disclose a first embodiment of a female connector for high-speed transmission, the female connector including a case 1, an insulating body, an upper terminal group 31, and a lower terminal group 32. The insulating body is divided into three parts, i.e., an upper insulating body 21, a middle insulating body 22, and a lower insulating body 23. The upper terminal group 31 is disposed on the upper insulating body 21. The lower terminal group 32 is disposed on the lower insulating body 23. The three parts of the insulating body are engaged via a first shielding engaging case 41 and a second shielding engaging case 42. A first hook 411 is disposed on the first shielding engaging case 41. A second hook 421 is disposed on the second shielding engaging case 42. A first hooking portion 221 and a second hooking portion 222 are disposed on the upper surface and the lower surface of the middle insulating body 22, respectively. The first shielding engaging case 41 is engaged with the upper surface of the middle insulating body 22, wherein the first hook 411 is interlocked with the corresponding second hooking portion 222 on the middle insulating body 22. The second shielding engaging case 42 is engaged with the lower surface of the middle insulating body 22, wherein the second hook 421 is interlocked with the corresponding first hooking portion 221 on the middle insulating body 22. Thus a connector body 5 is formed. Then, the connector body 5 is disposed in the case 1 (as shown in FIG. 2). To prevent dust from entering the connector body 5, the connector body 5 is covered with a cap 6. The cap 6 facilitates the transfer of the connector by adsorption through the assembly line (as shown in FIG. 3). Thus, the manner dividing the insulating body into three parts and then engaging the three parts together via shielding engaging cases can satisfy the fabrication requirements for different types of terminals, and the female connector for high-speed transmission can be tightly assembled.

To achieve the high frequency transmission, the upper terminal group 31 and/or the lower terminal group 32 at least includes a high frequency terminal pair 311. The thickness of a contact portion 3111 of the high frequency terminal pair 311 is smaller than the thickness of a portion 3112 adjacent to the contact portion 3111.

The thickness of the contact portion 3111 of the high frequency terminal pair 311 is larger than or equal to 60% of the thickness of the portion 3112 adjacent to the contact portion 3111, and is smaller than or equal to 90% of the thickness of the portion 3112 adjacent to the contact portion 3111.

The width of a portion of the high frequency terminal pair inside of the insulating body is smaller than the width of an adjacent low frequency terminal or grounding terminal.

Figure 4:
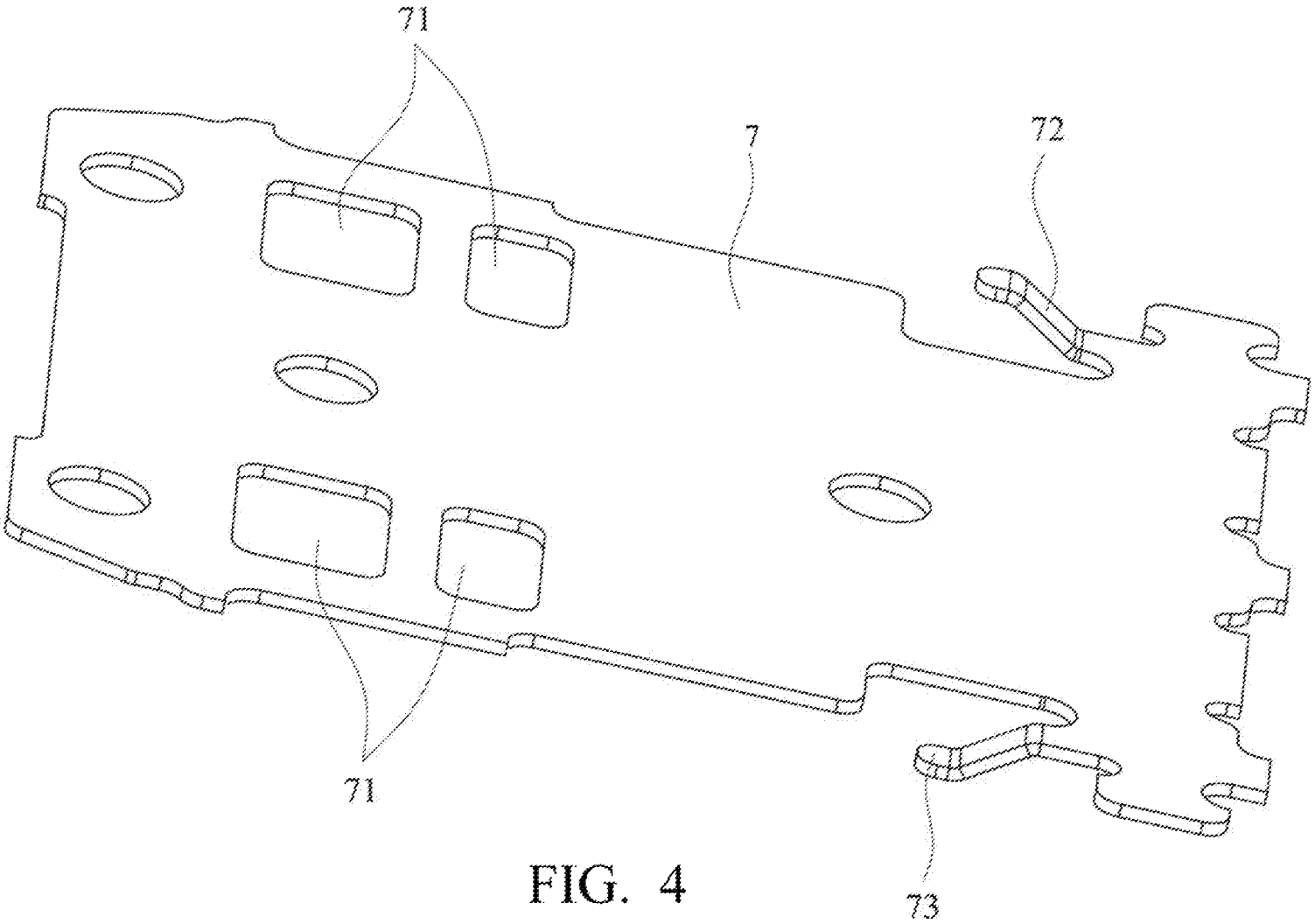
FIG. 4 is a schematic diagram of the metal sheet in the middle insulating body of FIG. 1.

The middle insulating body 22 further includes a metal sheet 7 (as shown in FIG. 4). The metal sheet 7 includes a plurality of through holes 71 for improving high frequency performance. The metal sheet 7 further includes an upper spring plate 72 and a lower spring plate 73. When the upper insulating body 21 and the lower insulating body 23 are engaged with the middle insulating body 22 to form an integrated device, the upper spring plate 72 is physically and electrically connected to a first grounding terminal 312 on the upper insulating body 21, and the lower spring plate 73 is physically and electrically connected to a second grounding terminal 313 on the lower insulating body 23.

To make the case 1 more robust and to prevent the dovetail connection from being popped out, a rib 11 is disposed around the case 1.

The present invention can be implemented as a second embodiment (not shown in the figures). The second embodiment is essentially the same as the first embodiment, except that the upper insulating body and/or the lower insulating body includes a hook, and the lower insulating body and/or the upper insulating body includes a hooking portion. The hook is interlocked with the hooking portion to tightly engage the three parts of the insulating body.

What is claimed is:

1. A female connector for high-speed transmission, comprising:

a case;

a rib disposed around the case;

an insulating body comprising an upper insulating body, a middle insulating body, and a lower insulating body;

an upper terminal group;

a lower terminal group, wherein one or both of the upper terminal group and the lower terminal group includes a high frequency terminal pair, and a thickness of a contact portion of the high frequency terminal pair is smaller than a thickness of a portion of the high frequency terminal pair adjacent to the contact portion, wherein the upper terminal group is disposed on the upper insulating body; the lower terminal group is disposed on the lower insulating body; the upper insulating body and the lower insulating body are engaged with the middle insulating body to enable the insulating body to be an integrated connector body; and the integrated connector body is disposed in the case.

2. The female connector of claim 1, wherein the thickness of the contact portion of the high frequency terminal pair is larger than or equal to 60% of the thickness of the portion of the high frequency terminal pair adjacent to the contact portion, and is smaller than or equal to 90% of the thickness of the portion of the high frequency terminal pair adjacent to the contact portion.

3. The female connector of claim 1, wherein a width of a portion of the high frequency terminal pair inside of the insulating body is smaller than a width of a low frequency terminal or a grounding terminal adjacent to the portion of the high frequency terminal pair.

4. The female connector of claim 2, wherein a width of a portion of the high frequency terminal pair inside of the insulating body is smaller than a width of a low frequency terminal or a grounding terminal adjacent to the portion of the high frequency terminal pair.

5. The female connector of claim 1, further comprising: a first shielding engaging case;

a second shielding engaging case;

a first hook disposed on the first shielding engaging case;

a second hook disposed on the second shielding engaging case;

a first hooking portion disposed on an upper surface of the middle insulating body; and a second hooking portion disposed on a lower surface of the middle insulating body, wherein the first shielding engaging case is engaged with the upper surface of the middle insulating body, while the first hook is interlocked with the second hooking portion on the middle insulating body corresponding to the first hook; and the second shielding engaging case is engaged with the lower surface of the middle insulating body, while the second hook is interlocked with the first hooking portion on the middle insulating body corresponding to the second hook.

6. The female connector of claim 2, further comprising:

a first shielding engaging case;

a second shielding engaging case;

a first hook disposed on the first shielding engaging case;

a second hook disposed on the second shielding engaging case;

a first hooking portion disposed on an upper surface of the middle insulating body; and a second hooking portion disposed on a lower surface of the middle insulating body, wherein the first shielding engaging case is engaged with the upper surface of the middle insulating body, while the first hook is interlocked with the second hooking portion on the middle insulating body corresponding to the first hook; and the second shielding engaging case is engaged with the lower surface of the middle insulating body, while the second hook is interlocked with the first hooking portion on the middle insulating body corresponding to the first hook.

7. The female connector of claim 1, wherein the middle insulating body includes a metal sheet, and the metal sheet includes a plurality of through holes for improving high frequency performance.

8. The female connector of claim 2, wherein the middle insulating body includes a metal sheet, and the metal sheet includes a plurality of through holes for improving high frequency performance.

9. The female connector of claim 7, wherein the metal sheet further includes an upper spring plate and a lower spring plate, wherein the upper spring plate is physically and electrically connected to a first grounding terminal on the upper insulating body, and the lower spring plate is physically and electrically connected to a second grounding terminal on the lower insulating body.

10. The female connector of claim 8, wherein the metal sheet further includes an upper spring plate and a lower spring plate, wherein the upper spring plate is physically and electrically connected to a first grounding terminal on the upper insulating body, and the lower spring plate is physically and electrically connected to a second grounding terminal on the lower insulating body.

* * * * *